United States Patent [19]

Hogg

[11] Patent Number: 4,866,457

[45] Date of Patent: Sep. 12, 1989

[54] COVERED INVERTED OFFSET CASSEGRAINIAN SYSTEM

[75] Inventor: David C. Hogg, Boulder, Colo.

[73] Assignee: The United States of America as represented by the Secretary of Commerce, Washington, D.C.

[21] Appl. No.: 268,430

[22] Filed: Nov. 8, 1988

[51] Int. Cl.[4] ..... H01Q 1/42

[52] U.S. Cl. ..... 343/781 CA; 343/872

[58] Field of Search ..... 343/781 R, 781 P, 781 CA, 343/704, 840, 872

[56] References Cited

U.S. PATENT DOCUMENTS

| | | | |
|---|---|---|---|
| 2,679,003 | 5/1954 | Dyke . | |
| 2,679,004 | 5/1954 | Dyke . | |
| 3,810,187 | 5/1974 | Hai | 343/781 |
| 3,850,504 | 11/1974 | Bisbee | 350/65 |
| 3,995,275 | 11/1976 | Betsudan | 343/781 CA |
| 4,096,483 | 6/1978 | Bui Hai | 343/781 CA |
| 4,126,864 | 11/1978 | Hopkins | 343/872 |
| 4,195,302 | 3/1980 | Leupelt | 343/704 |

FOREIGN PATENT DOCUMENTS

| | | | |
|---|---|---|---|
| 5192498 | 2/1978 | Japan . | |
| 0129565 | 11/1978 | Japan | 343/781 CA |
| 0136941 | 11/1978 | Japan | 343/781 CA |

OTHER PUBLICATIONS

Blevis, B. C., "Losses Due to Rain on Radomes and Antenna Reflecting Surfaces," IEEE Trans. Antennas Propagation, vol. AP-13, pp. 175-176, Jan., 1965.

Gibble, D., "Effects of Rain on Transmission Performance of a Satellite Communication System," IEEE Intl. Convention Record, Part 6, p. 52, Mar., 1964.

Hogg, D. C. and Ta-Shing Chu, "The Role of Rain in Satellite Communications," Proc. IEEE, vol. 63, No. 9, pp. 1308-1330, Sep., 1975.

Dragone, C. and D. C. Hogg, "The Radiation Pattern and Impedance of Offset and Symmetrical Near-Field Cassegrainian and Gregorian Antennas," IEEE Trans. Antennas Propagation, vol. AP-22, No. 3, pp. 472-475, May, 1974.

Chu, T. S., R. W. Wilson, R. W. England, D. A. Grey, & W. E. Legg, "The Crawford Hill 7-Meter Millimeter-Wave Antenna," Bell Syst. Tech. Jour., vol. 57, No. 5, pp. 1257-1288, May, 1978.

Hogg, D. C. & R. A. Semplak, "An Experimental Study of Near-Field Cassegranian Antennas", Bell Syst. Tech. Jour., vol. 43, pp. 2677-2704, Nov., 1964.

Anderson, I., "Measurements of 20 GHz Transmission through a Wet Radome," IEEE Trans. Antennas Propagation, vol. AP-23, pp. 619-622, Sep., 1975.

Giger, A. J., "4 Gc Transmission Degradation due to Rain at the Andover, Maine, Satellite Station," Bell Syst. Tech. Jour., vol. 44, No. 7, pp. 1528-1533, Sep., 1965.

Jacobson, M. D., D. C. Hogg, & J. B. Snider, "Wet Reflectors in Millimeter-Wave Radiometry-Experiment and Theory," IEEE Trans. Geosc. and Remote Sensing, vol. GE-24, No. 5, pp. 784-791, Sep., 1986.

*Primary Examiner*—Rolf Hille
*Assistant Examiner*—Doris J. Johnson
*Attorney, Agent, or Firm*—Thomas Zack; Alvin J. Englert; William L. Feeney

[57] ABSTRACT

An inverted offset system is used for sending and/or receiving electromagnetic energy. The system, which is preferably a Cassegrainian microwave antenna system, includes a water-tight cover to protect the feed compartment, subreflector, and main reflector of the antenna. The cover protects against the effects of precipitation and is especially useful when the system is used for measuring atmospheric conditions such as rain or snow. A waterguard ridge and drain passageway are used to protect the feed compartment from precipitation when the antenna is disposed in a position to send or receive beams which are substantially vertical.

20 Claims, 2 Drawing Sheets

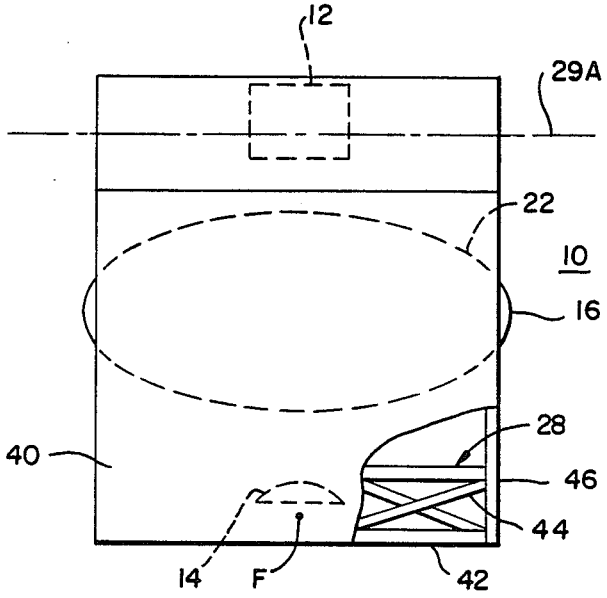
FIG 3
FIG 5
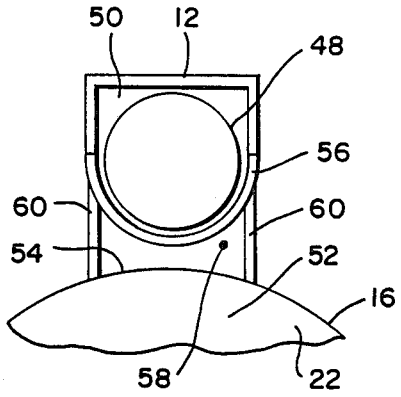
FIG 4
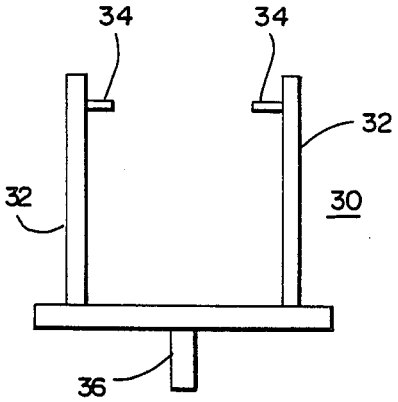
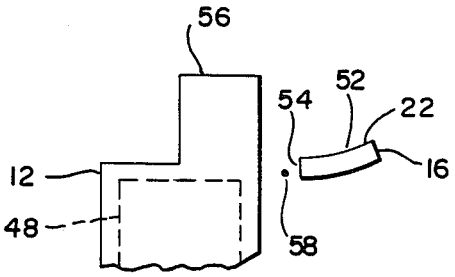
FIG 6

COVERED INVERTED OFFSET CASSEGRAINIAN SYSTEM

BACKGROUND OF THE INVENTION

This invention relates to systems for receiving and/or transmitting electromagnetic energy and, more specifically, a covered inverted offset Cassegrainian antenna design.

Various antennas have been used to measure the atmosphere by way of electromagnetic radiation. Under such circumstances, rain, ice, and snow will degrade the performance of the antenna. That is, the measurements made from the electromagnetic waves using the antenna do not represent only the snow or rain in the atmosphere, but may develop a significant degree of dependence upon the degraded performance of the antenna resulting from rain, ice, or snow. Avoidance of this degradation is also important in millimeter wave communication and radar systems.

The following publications are helpful in explaining the background of the present invention:

(1) Blevis, B. C., "Losses due to rain on radomes and antenna reflecting surfaces," IEEE Trans. Antennas Propagation, vol. AP-13, pp. 175–176, January, 1965.

(2) Gibble, D., "Effects of rain on transmission performance of a satellite communication system," IEEE Intl. Convention Record, Part 6, p. 52, March, 1964.

(3) Hogg, D. C. and Ta-Shing Chu, "The role of rain in satellite communications," Proc. IEEE, vol. 63, no. 9, pp. 1308–1330, September, 1975.

(4) Anderson, I., "Measurements of 20 GHz transmission through a wet radome," IEEE Trans. Antennas Propagation, vol. AP-23, pp. 619–622, September, 1975.

(5) Giger, A. J., "4 Gc Transmission degradation due to rain at the Andover, Maine, Satellite Station," Bell Syst. Tech. Jour., vol. 44, no. 7, pp. 1528–1533, September, 1965.

(6) Jacobson, M. D., D. C. Hogg, and J. B. Snider, "Wet reflectors in millimeter-wave radiometry—experiment and theory," IEEE Trans. Geosc. and Remote Sensing, vol. GE-24, no. 5, pp. 784–791, September, 1986.

(7) Dragone, C. and D. C. Hogg, "The radiation pattern and impedance of offset and symmetrical near-field Cassegrainian and Gregorian antennas," IEEE Trans. Antennas Propagation, vol. AP-22, no. 3, pp. 472–475, May, 1974.

(8) Chu, T. S., R. W. Wilson, R. W. England, D. A. Gray, and W. E. Legg, "The Crawford Hill 7-meter millimeter-wave antenna," Bell Syst. Tech. Jour., vol. 57, no. 5, pp. 1257–1288, May 1978.

(9) Hogg, D. C. and R. A. Semplak, "An experimental study of near-field Cassegrainian antennas," Bell Syst. Tech. Jour., vol. 43, pp. 2677–2704, November, 1964.

In the discussion that follows, parenthetical references will be made to the above publications by number.

A technique which has been used to try to minimize weather degradation of an antenna has involved the use of a radome. However, both theory (1, 2, and 3) and experiment (4 and 5) show that the layer of liquid that forms on a radome during rain still has a tendency to degrade antenna performance, especially at millimeter wave lengths. Additionally, the system noise temperature where low-noise receivers are needed is also adversely affected. Wet reflectors do not appear to present as serious a problem with degradation (6, 1, and 3).

The bisected (or offset) Cassegrainian (or Gregorian) antenna is recognized to have several advantages (7). One advantage is that the aperture is not blocked such that the aperture efficiency and radiation patterns are very good. The impedance characteristics of such antennas are good with the feed horn being the only limitation in practice. The subreflector can be designed to be as large as desired without introducing blockage. Further, the cross-polarization discrimination is very good because of the long effective focal length.

Although this type of design has been implemented in antennas of very high quality that show superior performance in the above respects (8), such designs have included a significant undesirable feature. That undesirable feature is that the "standard" bisected (offset) Cassegrainian is highly susceptible to degradation caused by rain and wet snow falling at the site of the antenna.

It should be noted that the feed for a Cassegrainian antenna can be of various different types. For example, a near-field (plane-wave) type of feed uses a paraboloidal subreflector, thereby constituting a near-field Cassegrainian (9). Alternately, the feed might be an ellipsoidal reflector as discussed by Chu (8) to provide an appropriate beam waist with an hyperboloidal subreflector.

In addition to the above publications, the following patents (U.S. Patents unless indicated otherwise) are noted:

| Pat. No. | Inventor | Date |
|---|---|---|
| 2,679,003 | Dyke et al. | May 18, 1954 |
| 2,679,004 | Dyke et al. | May 18, 1954 |
| 3,810,187 | Hai | May 7, 1974 |
| 3,850,504 | Bisbee | Nov. 26, 1974 |
| 3,995,275 | Betsudan et al. | Nov. 30, 1976 |
| 4,096,483 | Bui Hai et al. | Jun. 20, 1978 |
| 4,195,302 | Leupelt | Mar. 25, 1980 |
| Japanese 51-92498 | Mizusawa | Feb. 1978 |

The Dyke patents show a microwave antenna having a heater system and/or a snow detector and including drain holes incorporated in the center of a reflector portion of the antenna.

The Hai patent shows a Cassegrainian antenna having a cap which is metal and has an inner absorbent layer. The cap incorporates a screen to absorb diffracted waves and to prevent reflection of external parasitic waves and thus provide a better antenna pattern. Additionally, the cap is said to provide climatic protection of the antenna and is adapted to shift depending on the wind.

The Bisbee patent shows Cassegrainian telescope with an inflatable door to protect the telescope.

The Betsudan patent shows an antenna which is structured so that there is minimal effect from rain or snow on the primary radiator.

The Bui Hai patent shows a Cassegrainian antenna which is operable at two different frequency bands.

The Leupelt patent shows a Cassegrainian antenna whereby a thin foil is used to protect the horn from rain and snow.

The Japanese published patent application shows an antenna having a shield.

Although the above designs have been generally useful, they have often been subject to one or more of several significant disadvantages. For example, some of the designs do not allow the antenna to move. Other designs allow the antenna to move, but without maintaining a substantial degree of protection. Under some designs, the range of movement of the antenna is severely limited to avoid problems with water flow on the antenna surfaces some designs have required electromagnetic screens to provide good antenna patterns.

OBJECTS AND SUMMARY OF THE INVENTION

Accordingly, it is a primary object of the present invention to provide a new and improved system.

A more specific object of the present invention is to provide a simple and effective way of protecting an antenna or other system against degradation caused by rain and snow without having the disadvantages common with a radome.

A still further object of the present invention is to provide an antenna or other system which avoids or minimizes all of the problems discussed above.

The above and other objects of the present invention are realized by an inverted offset system for receiving and/or transmitting electromagnetic waves with a feed aperture having an electromagnetic transducer disposed for supplying and/or receiving a beam of electromagnetic waves passing generally along a first line through the feed aperture. A subreflector is disposed at an end of the first line opposite an end of the first line which corresponds to the feed aperture. The subreflector is also disposed at an end of a second line and is operable to transfer electromagnetic energy between the first and second lines. A main reflector has a reflection surface on a front thereof and is disposed at an end of the second line opposite the end of the second line which has the subreflector. The main reflector is disposed at an end of a third line which corresponds to an external beam direction. The system is operable for passage of electromagnetic energy between the external beam direction and the electromagnetic transducer by way of the subreflector and the main reflector. A frame is used to support the feed aperture, subreflector, and main reflector in an established relationship with the first line above the third line when the frame is in a first position. The frame has an upper part extending from above the feed aperture to above the subreflector and having the subreflector secured directly thereto. A cover is mounted directly to the upper part of the frame, the cover being operable to prevent precipitation from reaching the first line, second line, and a close-in portion of the third line when the frame is in the first position. None of the first, second, and third lines pass through the cover. The cover is radio-transparent, meaning that microwave signals pass readily therethrough. The inverted offset system is preferably a Cassegrainian system and, more specifically, a Cassegrainian antenna. The electromagnetic transducer is a feedhorn adapted to receive microwaves. The cover is fixed in position relative to the feed aperture and the subreflector. The reflection surface is a section of a paraboloid, the paraboloid having an axis of symmetry above the first line and within the cover. The system further includes a drain passage at an adjacent portion of the reflection surface. The drain passage is a gap between the main reflector and the feed aperture. A waterguard ridge projects in front and substantially normal to a plane tangent to an adjacent portion of the reflection surface, the adjacent portion being adjacent to the feed aperture and having an edge. The waterguard ridge blocks flow of water from the reflection surface to the feed aperture when the frame is in a second position with the reflection surface tilted downwardly towards the feed aperture. The frame is pivotably mounted upon a support for movement between the first position and the second position.

BRIEF DESCRIPTION OF THE DRAWINGS

The above and other features of the present invention will be more readily understood when the following detailed description is considered in conjunction with the accompanying drawings wherein like characters represent like parts throughout the several views and in which:

FIG. 3 shows a simplified top view of the present invention;

FIG. 4 shows a simplified front view of the support for use with the frame of the present invention;

FIG. 5 shows a close-up front view of the feed aperture and associated portions of the present invention; and FIG. 6 shows a side view of the feed aperture and associated portions of the present invention with the system positioned to provide an essentially vertical external beam direction.

DETAILED DESCRIPTION

Figure 1:
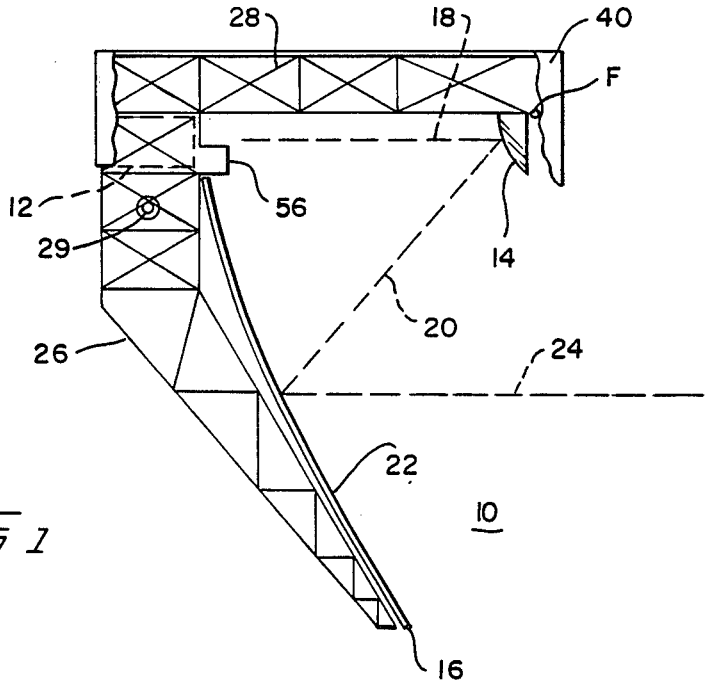
FIG. 1 shows a simplified side view of the present invention.

The inverted offset system 10 of the present invention will now be discussed initially with respect to FIG. 1. The feed compartment 12 includes a transducer (now shown in FIG. 1) to receive and/or transmit a beam of electromagnetic waves passing generally along line 18. The subreflector 14 is disposed at an end of the line 18 opposite to the end having the feed compartment 12 and is disposed at an end of a second line 20 which corresponds to passage of a beam of electromagnetic energy between the subreflector 14 and a reflection surface 22 of the main reflector 16. A third line 24 corresponds to an external beam direction. The beam along line 24 is "external" in that it corresponds to transmission of electromagnetic energy to a remote station or otherwise out into the atmosphere and/or reception of electromagnetic energy from a remote station or otherwise from the atmosphere or other remote location. The system is an inverted offset system in that the first line 18 is above and offset from the external beam or third line 24. As shown in FIG. 1, the system 10 is a Cassegrainian antenna with a focal point F disposed in line with the second line 20 and just beyond the subreflector 14. The subreflector 14 might be the convex surface of a paraboloid, half-paraboloid, or hyperboloid, whereas the reflection surface 22 of the main reflector 16 is the concave side of a section of a paraboloid having its axis of symmetry extending parallel to line 18 and intersecting with focal point F. The system 10 is an inverted offset system in that the first direction line 18 and the third direction line 24 are offset from each other. As shown, the feed compartment 12, subreflector 14, and main reflector 22 are secured to a frame 26 having an upper portion 28. The frame 26 is shown illustratively as a truss-type structure, but various other known structures might be used. The details of the frame 26 need not be discussed in detail, it being sufficient to note that the feed compartment 12, subreflector 14, and main reflector 22 would be secured to the frame in any of various known fashions. The frame 26 includes a sleeve 29 for accommodating a pin (pin not shown in FIG. 1). With momentary reference to FIG. 4, there is shown a support 30 having two upstanding arms 32 upon which two pins 34 are disposed. The pins 34 would fit into the sleeve or cylinder 28 of FIG. 1 such that the frame 26 may rotate or pivot along an axis corresponding to the sleeves 28 and pins 34 from the first position shown in FIG. 1 wherein the external beam direction 24 is generally horizontal to a second position (not shown) wherein the beam direction 24 is generally vertical. The rotation of the frame 26 relative to the support 30 may be accomplished in any of various known fashions and an axle could be used in place of the pins 34. The support 30 includes a downwardly extending cylindrical member 36 which would be mounted in an anchor not shown) and which allows the support 30 to be rotated about a vertical axis corresponding to the central axis of member 36. The rotation about member 36 and about the pins 34 allows one to change the external beam direction 24 to any of various settings.

With reference again to FIG. 1, a cover 40 is disposed over the upper part of frame 28. For ease of illustration, a large portion of the cover 40 has been removed from FIG. 1.

Figure 2:
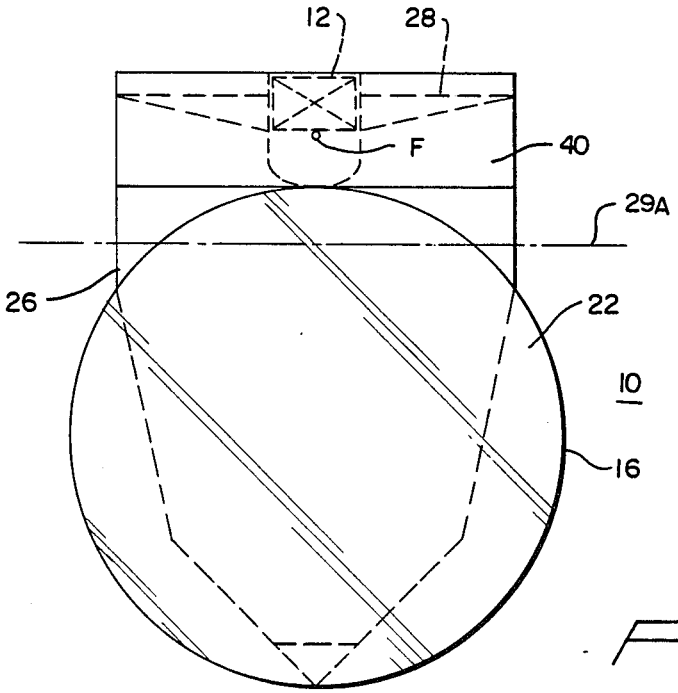
FIG. 2 shows a simplified front view of the present invention.

Continuing to view FIG. 1, but also considering FIG. 2 and FIG. 3, the cover 40 surrounds the feed compartment 12, line 18, and the subreflector 14 on all sides except the underside of the feed compartment 12 and subreflector 14. In the first position of FIG. 1 wherein the external beam direction or line 24 is generally horizontal, the cover 40 completely protects the high density energy passing along the first line between the feed compartment 12 and the subreflector 14. Although the energy density is somewhat less between the subreflector 14 and the main reflector 16, the cover 40 will likewise completely protect the beam of electromagnetic energy along line 20 from the effects of snow, rain, or other precipitation. Finally, the cover 40 protects against rain, snow, or other precipitation interfering with the reflection of electromagnetic energy from the reflection surface 22 and from interfering with a close-in portion of the third line or external beam direction 24.

The cover 40 is preferably made of a lightweight plastic which is resistant to ultraviolet damage such that the cover 40 will not degrade quickly in the sunlight. Any of various known plastics could be used. As there is no need to shield the structure 10 from stray electromagnetic signals, the cover 40 of material which is impermeable to water may be radio-transparent and need not be made of generally heavier materials which are used to block stray electromagnetic signals. In other words, the cover 40 is not metal or other material which blocks microwave transmission.

The upper portion 28 of frame 26 is only schematically illustrated in FIG. 2, whereas the top view of FIG. 3 shows a possible arrangement whereby the upper portion 28 may include sideways extending bars 42, crossbars 44, and front to back extending bars 46, only some of which are illustrated in FIG. 3. As will be appreciated from FIG. 3, the cover 40 covers substantially all (i.e., more than 90%) of the reflection surface 22 of the main reflector 16.

From the views of FIG. 2 and FIG. 3, it should be appreciated that the cover 40 is generally shaped like a rectangular box with the bottom removed. It should also be noted that FIGS. 2 and 3 include the axis of rotation or pivoting 29A corresponding to the sleeve or cylinder 29 of FIG. 1 and the pins 34 of FIG. 4.

With reference now to FIG. 5, there is shown a close-up of the feed compartment 12. As illustrated, a microwave feedhorn 48 is disposed in the compartment 12 and is used for receiving and/or transmitting electromagnetic energy passing through the feed aperture 50 corresponding to the open front of the compartment 12. The main reflector 16 has an adjacent portion 52 of the reflection surface 22, the adjacent portion 52 being adjacent to the feed aperture 50 and having an edge 54. In order to prevent water from rain or other precipitation from flowing off of the adjacent portion 52 into the feed aperture 50, a waterguard ridge 56 is disposed to at least partly surround the feed aperture 50. With momentary reference back to FIG. 1, the waterguard ridge 56 extends frontwardly from the feed compartment 12 towards the subreflector 14. In the position shown in FIG. 1, there would not be a problem with water flowing from the reflection surface 22 into the feed compartment. However, upon the frame 26 being rotated such that the beam direction third line 24 is essentially vertical, rain water flowing off the main reflector 16 might enter into the feed compartment 12 and interfere with the operation of the feedhorn 48. As shown in FIG. 5, the passage of water into the feed compartment is prevented by the semi-cylindrical waterguard ridge 56 together with a gap 58 corresponding to a water passageway between the edge 54 of the adjacent portion 52 of reflection surface 22 and the ridge 56. A portion of the frame 26 is illustrated as members 60 in FIG. 5.

FIG. 6 shows the feed compartment 12 and associated components from the side and following to rotation of the frame 26 90° counterclockwise (relative to the view of FIG. 1) such that the external beam direction 24 would be essentially vertical. In that position, water on the adjacent portion 52 of the main reflection surface 22 will flow over the edge 54 and pass downwardly through the gap 58 without going into the feed compartment 12, the feed compartment 12 being protected by the projecting waterguard ridge 56. As shown, the ridge 56 projects in front (i.e., upward in FIG. 6) and substantially normal to a plane (not shown) tangent to the adjacent portion 52 of the reflection surface 22.

With reference again to FIG. 1, it will be appreciated that all three elements, feed compartment 12, subreflector 14, and main reflector 16, are protected from precipitation when the system 12 is in the first position shown in FIG. 1. As the frame 26 rotates counterclockwise, there is less protection for the main reflector 22, but the water-tight cover 40 still provides good protection for the feed compartment 12 and the subreflector 14. Additionally, up to about a 45° angle of line 24 relative to horizontal, the cover 40 protects the beam along line 18 and the beam along line 20 quite well. Even when the beam direction 24 is vertical due to 90° rotation of the frame 26 from the position of FIG. 1, the cover 40 still protects the feed compartment 12, subreflector 14, and the high-density beam on line 18. It is in that vertical external beam position that the waterguard ridge 56 is most useful.

In the discussion above, the system 10 is a microwave antenna. Although the antenna could be used for various purposes, it is especially well adapted for use in radiometry wherein atmospheric conditions are measured using electromagnetic waves. The system 10 uses the cover 40 and waterguard ridge 56 such that the measurements represent the snowy or rainy atmospheric properties and are substantially free of significant measurement errors arising from the changes in the antenna. In other words, unlike a radome, a layer of water will not collect on a portion of the structure in such a way as to degrade the properties of the system.

Although the preferred embodiment shows a Cassegrainian antenna, the concept of the present invention is also applicable to a Gregorian antenna. The Gregorian antenna has a different relationship between the focal point F and the subreflector 14, among other differences between the Gregorian and Cassegrainian antennas. As the Gregorian is a known type of antenna, the details of its structure need not be discussed.

Although the invention is illustrated with reference to an antenna system, the present invention could be part of a system using laser energy or other forms of electromagnetic energy. In the case of a laser system, the system might be a Cassegrainian telescope and a transducer within feed compartment would be used to supply or receive laser energy passing along direction 18. In that case, the main reflection surface 22 and the reflection surface of the subreflector 14 would have to be more smoothly polished than with a microwave system. As known, the required smoothness for a reflection surface depends upon the wavelength of the electromagnetic energy which the surface is designed to reflect.

Although various specific structures and details have been disclosed herein, it is to be understood that these are for illustrative purposes only. Various modifications and adaptations will be apparent to those of skill in the art. Accordingly, the scope of the present invention should be determined by reference to the claims appended hereto.

What is claimed is:

1. An inverted offset system for receiving and/or transmitting electromagnetic waves comprising:

a feed aperture having an electromagnetic transducer disposed for supplying and/or receiving a beam of electromagnetic waves passing generally along a first line through said feed aperture;

a subreflector disposed at an end of said first line opposite an end of said first line corresponding to said feed aperture and at an end of a second line, said subreflector operable to transfer electromagnetic energy between said first and second lines;

a main reflector having a reflection surface on a front thereof and disposed at an end of said second line opposite said end of said second line which has said subreflector and disposed at an end of a third line, said third line corresponding to an external beam direction, said system operable for passage of electromagnetic energy between said external beam direction and said electromagnetic transducer by way of said subreflector and said main reflector;

a frame to support said feed aperture, said subreflector, and said main reflector in an established relationship with said first line above said third line when the frame is in a first position;

said frame having an upper part extending from above said feed aperture to above said subreflector and having the subreflector secured directly thereto; a cover mounted directly to said upper part of said frame, said cover operable to prevent precipitation from reaching said first line, said second line and a close in portion of said third line when said frame is in the first position, none of said first, second, and third lines passing through said cover, said cover being radio-transparent.

2. The inverted offset system of claim 1 wherein said inverted offset system is a Cassegrainian system.

3. The inverted offset system of claim 2 wherein said inverted offset system is an antenna.

4. The inverted offset system of claim 3 wherein said electromagnetic transducer is a feedhorn adapted to receive microwaves.

5. The inverted offset system of claim 1 wherein the cover is fixed in position relative to said feed aperture and said subreflector.

6. The inverted offset system of claim 1 further comprising:

a waterguard ridge projecting in front and substantially normal to a plane tangent to an adjacent portion of said reflection surface, said adjacent portion being adjacent to said feed aperture and having an edge, said waterguard ridge blocking flow of water from said reflection surface to said feed aperture when said frame is in a second position with said reflection surface tilted downwardly towards said feed aperture; and a support upon which said frame is pivotably mounted for movement between said first position and said second position.

7. The inverted offset system of claim 6 wherein said inverted offset system is an antenna.

8. The inverted offset system of claim 7 wherein said electromagnetic transducer is a feedhorn adapted to receive microwaves.

9. The inverted offset system of claim 8 wherein said inverted offset system is a Cassegrainian system.

10. The inverted offset system of claim 6 wherein said reflection surface is a section of a paraboloid, said paraboloid having an axis of symmetry above said first line and within said cover.

11. The inverted offset system of claim 10 further comprising a drain passage at said adjacent portion of said reflection surface.

12. The inverted offset system of claim 11 wherein said drain passage is a gap between said main reflector and said feed aperture.

13. An inverted offset system for receiving and/or transmitting electromagnetic waves comprising:

a feed aperture having an electromagnetic transducer disposed for supplying and/or receiving a beam of electromagnetic waves passing generally along a first line through said feed aperture;

a subreflector disposed at an end of said first line opposite an end of said first line corresponding to said feed aperture and at an end of a second line, said subreflector operable to transfer electromagnetic energy between said first and second lines;

a main reflector having a reflection surface on a front thereof and disposed at an end of said second line opposite said end of said second line which has said subreflector and disposed at an end of a third line, said third line corresponding to an external beam direction, said system operable for passage of electromagnetic energy between said external beam direction and said electromagnetic transducer by way of said subreflector and said main reflector;

a frame to support said feed aperture, said subreflector, and said main reflector in an established relationship with said first line above said third line when the frame is in a first position;

said frame having an upper part extending from above said feed aperture to above said subreflector and having the subreflector secured directly thereto;

a cover mounted directly to said upper part of said frame, said cover operable to prevent precipitation from reaching said first line, said second line and a close in portion of said third line when said frame is in the first position, none of said first, second, and third lines passing through said cover;

a waterguard ridge projecting in front and substantially normal to a plane tangent to an adjacent portion of said reflection surface, said adjacent portion being adjacent to said feed aperture and having an edge, said waterguard ridge blocking flow of water from said reflection surface to said feed aperture when said frame is in to a second position with said reflection surface tilted downwardly towards said feed aperture; and a support upon which said frame is pivotably mounted for movement between said first position and said second position.

14. The inverted offset system of claim 13 wherein the cover is fixed in position relative to said feed aperture and said subreflector.

15. The inverted offset system of claim 14 wherein said cover is radio-transparent.

16. The inverted offset system of claim 13 wherein said inverted offset system is a Cassegrainian system.

17. The inverted offset system of claim 16 wherein said inverted offset system is an antenna.

18. The inverted offset system of claim 17 wherein said electromagnetic transducer is a feedhorn adapted to receive microwaves.

19. The inverted offset system of claim 13 further comprising a drain passage at said adjacent portion of said reflection surface.

20. The inverted offset system of claim 19 wherein said drain passage is a gap between said edge of said adjacent portion of said reflection surface and said feed aperture.

* * * * *